US008530832B2

(12) United States Patent
Mordehai et al.

(10) Patent No.: US 8,530,832 B2
(45) **Date of Patent: *Sep. 10, 2013**

(54) ION SOURCES FOR IMPROVED IONIZATION

(75) Inventors: Alexander Mordehai, Santa Clara, CA (US); Mark H. Werlich, Santa Clara, CA (US); Craig P. Love, San Jose, CA (US); James L. Bertsch, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 79 days.

This patent is subject to a terminal disclaimer.

(21) Appl. No.: 13/251,886

(22) Filed: Oct. 3, 2011

(65) Prior Publication Data

US 2012/0025071 A1 Feb. 2, 2012

Related U.S. Application Data

(63) Continuation of application No. 12/418,509, filed on Apr. 3, 2009, now Pat. No. 8,039,795.

(60) Provisional application No. 61/042,703, filed on Apr. 4, 2008.

(51) Int. Cl.
*H01J 49/10* (2006.01)
*H01J 27/02* (2006.01)

(52) U.S. Cl.
USPC ..... 250/288; 250/281; 250/282; 250/423 R; 250/424; 250/423 F; 315/111.81; 315/111.01

(58) Field of Classification Search
USPC ..... 250/288, 281, 282, 423 R, 424, 423 F; 315/111.81, 111.01
See application file for complete search history.

(56) References Cited

U.S. PATENT DOCUMENTS

| | | | | |
|---|---|---|---|---|
| 4,861,988 | A | 8/1989 | Henion et al. | |
| 4,935,624 | A | 6/1990 | Henion | |
| 5,170,053 | A | 12/1992 | Hail et al. | |
| 5,349,186 | A | 9/1994 | Ikonomou et al. | |
| 5,352,892 | A | 10/1994 | Mordehai et al. | |
| 5,412,208 | A | 5/1995 | Covey et al. | |
| 5,495,108 | A | 2/1996 | Apffel et al. | |
| 5,543,618 | A | 8/1996 | D silva | |
| 5,750,988 | A | 5/1998 | Apffel et al. | |
| 6,114,693 | A | 9/2000 | Hirabayashi et al. | |
| 6,596,988 | B2 * | 7/2003 | Corso et al. | 250/288 |
| 6,646,257 | B1 | 11/2003 | Fischer et al. | |

(Continued)

FOREIGN PATENT DOCUMENTS

| | | |
|---|---|---|
| JP | 2007227254 | 9/2007 |
| WO | WO 2007/125297 A2 | 11/2007 |

OTHER PUBLICATIONS

"International Search Report in PCT/US/09/39563", (Jan. 7, 2010).

(Continued)

*Primary Examiner* — Nikita Wells

(57) ABSTRACT

Improved apparatuses and methods are provided for ionizing samples and analyzing the samples with mass spectrometry.

20 Claims, 15 Drawing Sheets

(56) References Cited

U.S. PATENT DOCUMENTS

| | | | | |
|---|---|---|---|---|
| 6,759,650 | B2 | 7/2004 | Covey et al. | |
| 6,998,605 | B1 | 2/2006 | Frazer et al. | |
| 7,199,364 | B2 * | 4/2007 | Thakur | 250/288 |
| 7,518,108 | B2 | 4/2009 | Frey et al. | |
| 7,812,308 | B2 * | 10/2010 | Kobayashi | 250/288 |
| 8,039,795 | B2 * | 10/2011 | Mordehai et al. | 250/288 |
| 2005/0230634 | A1 | 10/2005 | Bajic | |

OTHER PUBLICATIONS

Allen, et al., "Designand Performance of a Novel Electrospray Interface", J. Am. Soc. Mass Spectrometry, vol. 3, (1992),18-26.

Bruins, "Mass Spectrometry with ion sources operating at atmospheric pressure", Mass Spectrometry Reviews, vol. 10, (1991), 53-77.

Niessen, "Advances in instrumentation in liquid chromatography-mass spectrometry and related liquid introduction techniques", Journal of Chromatography A, vol. 794, (1998), 407-435.

* cited by examiner

Fig. 2, Prior Art

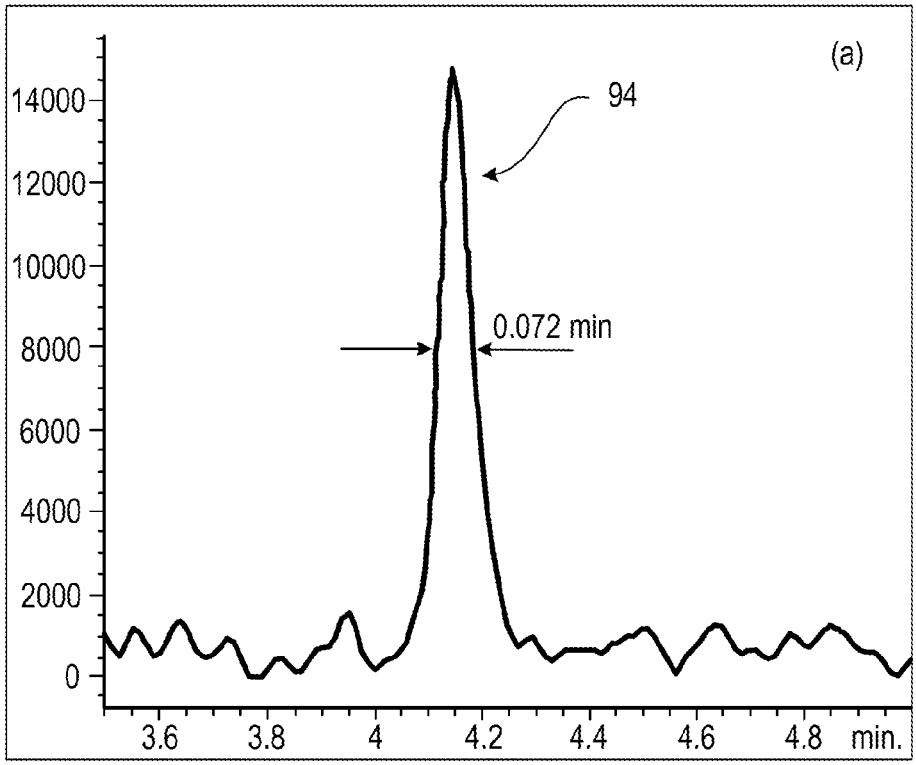
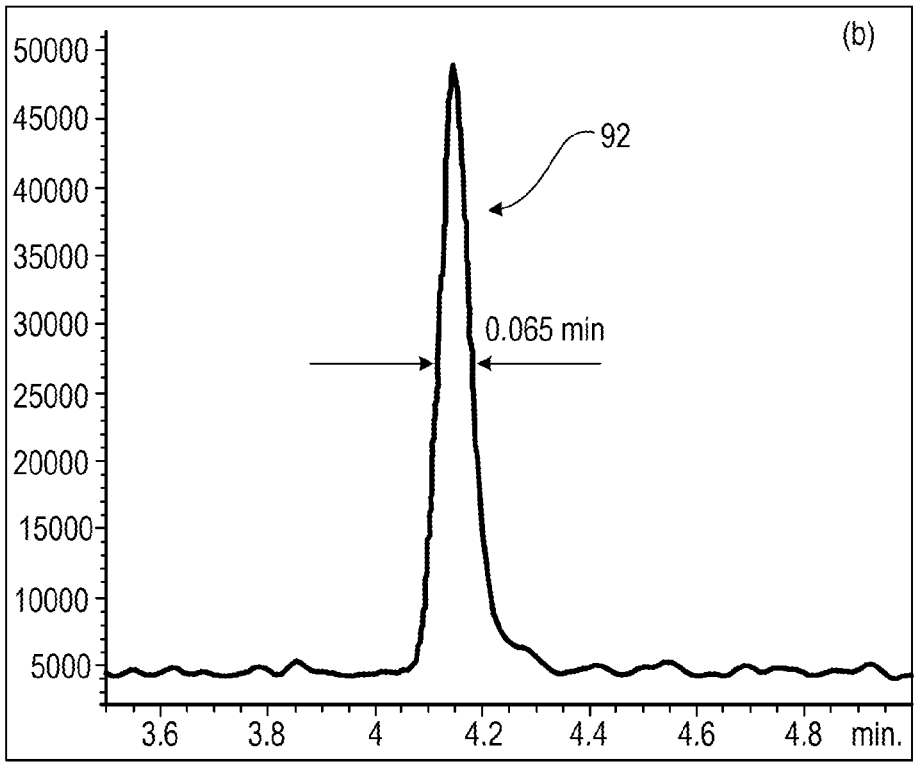
*Fig. 9*

9-phenanthrol
$C_{14}H_{10}O$
MW = 194.23
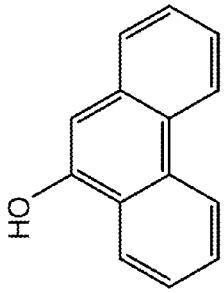
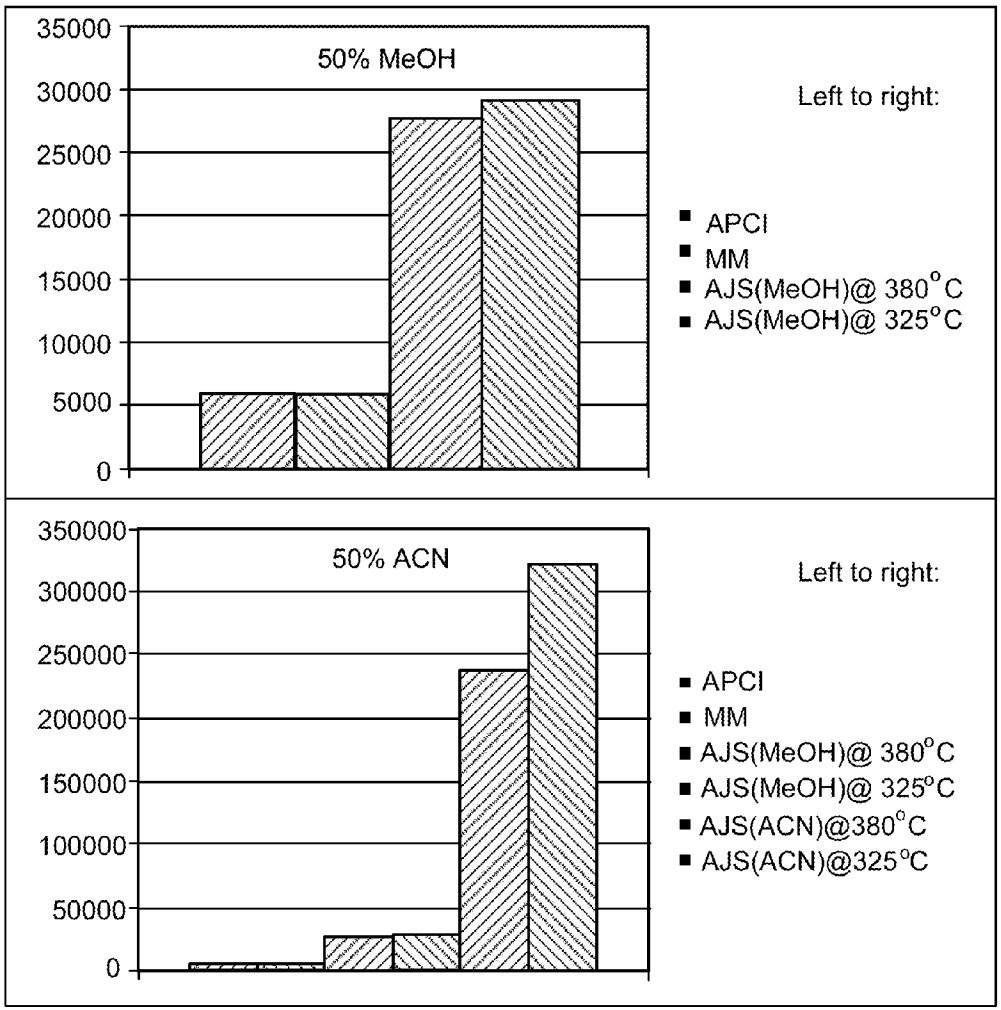
*Fig. 12*

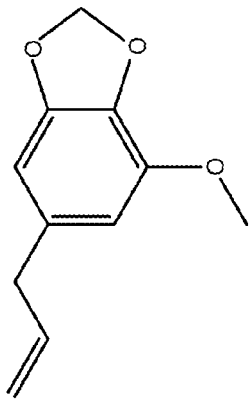
Myristicin
$C_{11}H_{12}O_3$
MW = 192.21
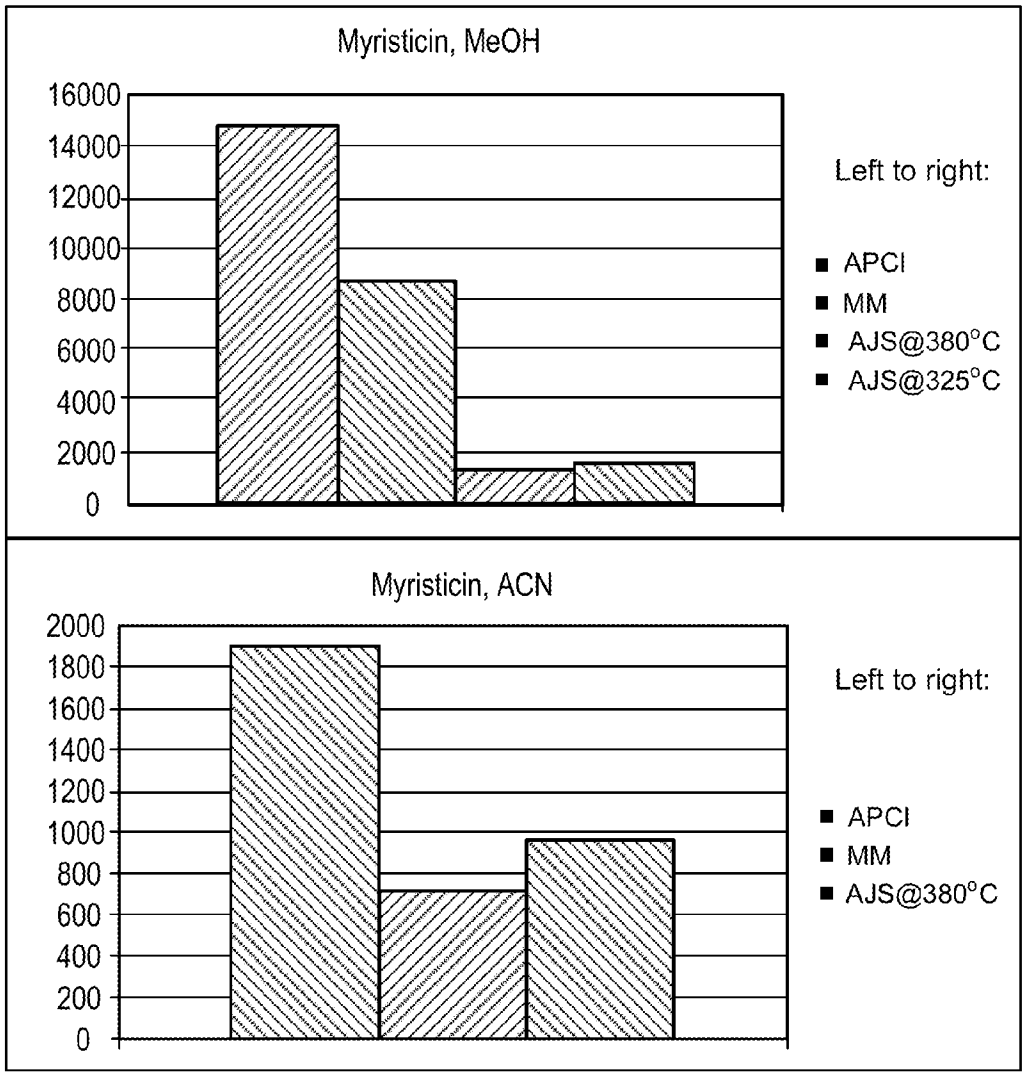
*Fig. 13*

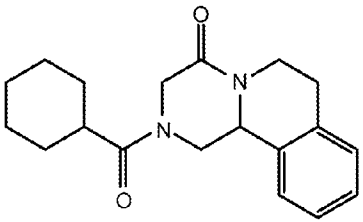
Praziquantel
$C_{19}H_{24}N_2O_2$
MW = 312.41
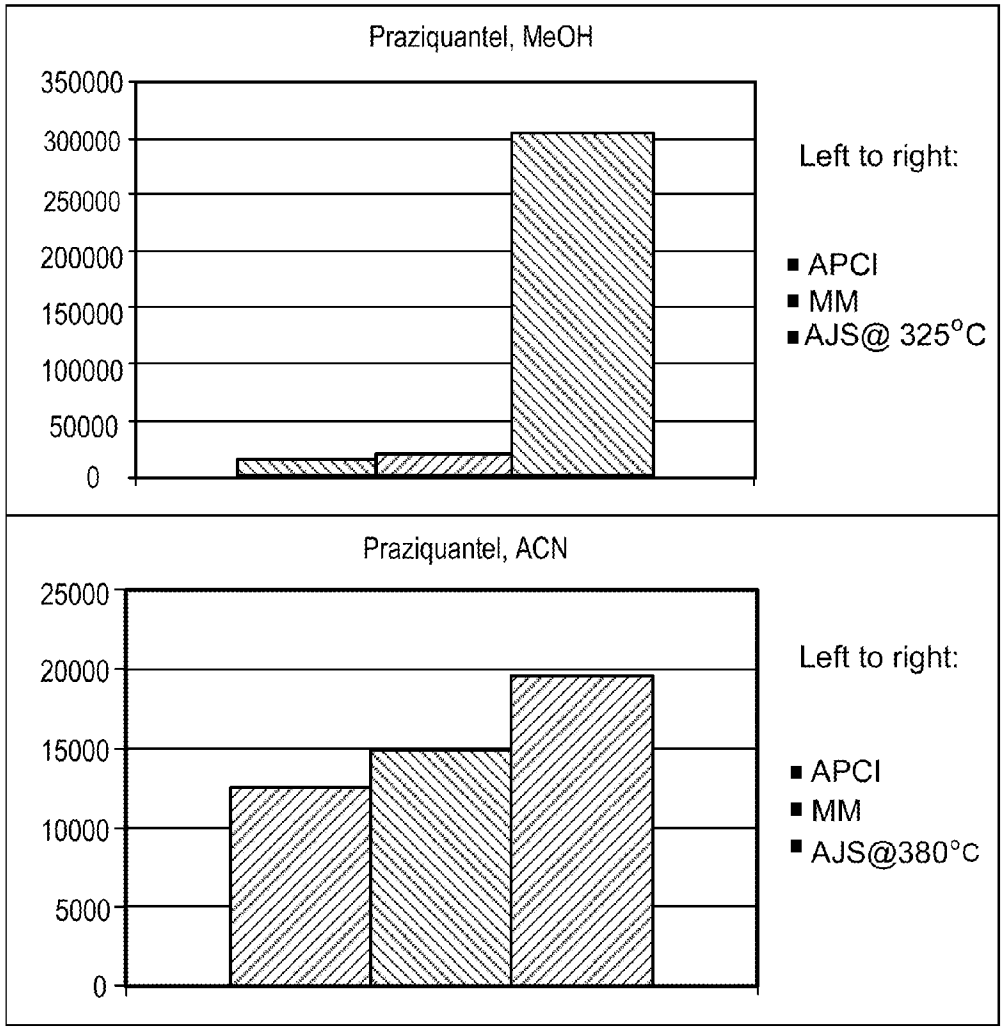
*Fig. 14*

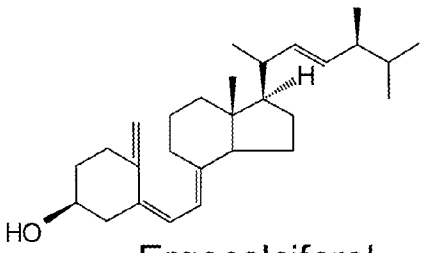
Ergocalciferol
$C_{28}H_{44}O$
MW = 396.65
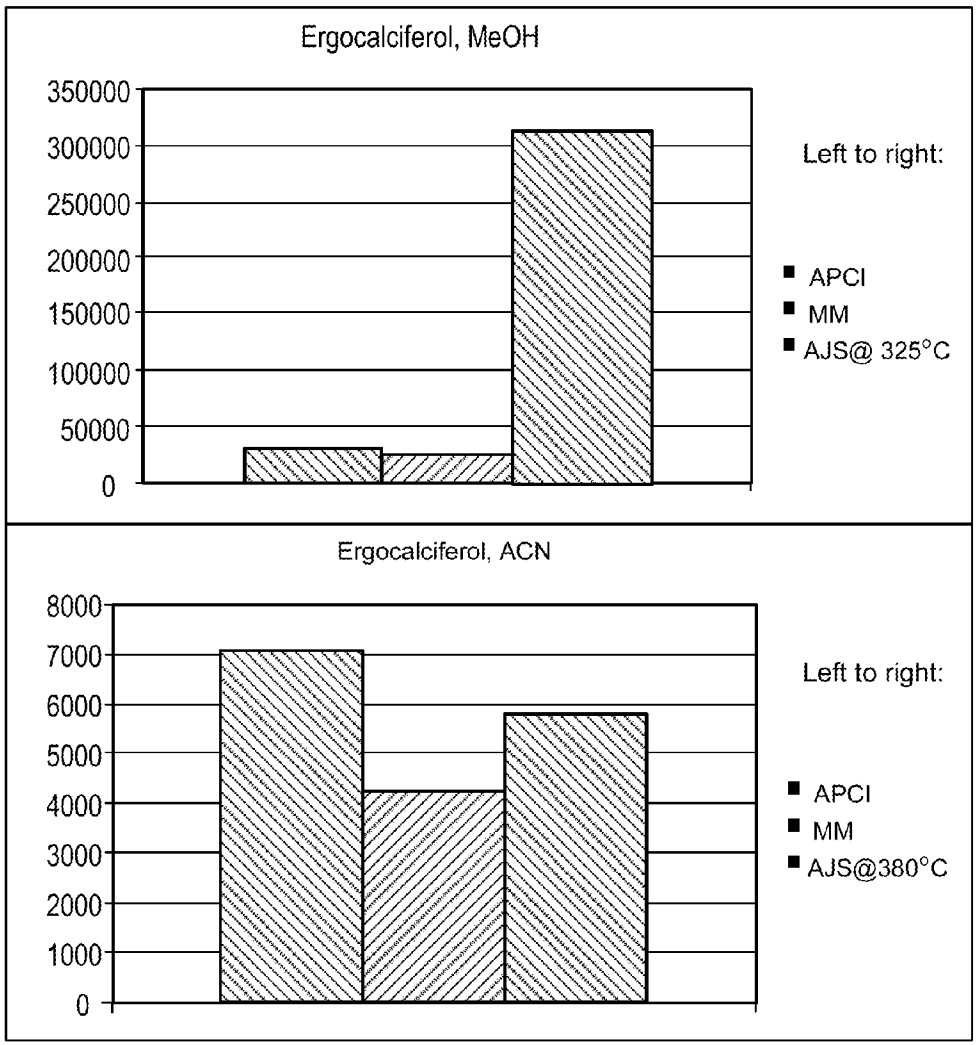
*Fig. 15*

ION SOURCES FOR IMPROVED IONIZATION

RELATED APPLICATIONS

This application is a continuation of U.S. patent application Ser. No. 12/418,509, filed Apr. 3, 2009, which claims the benefit of U.S. Provisional Patent Application No. 61/042,703, filed Apr. 4, 2008, both of which are incorporated herein by their entirety.

BACKGROUND

Mass spectrometry is an important tool in the analysis of components (or "analytes") in a sample. In a mass spectrometric analysis, a sample has to be ionized to generate ions of the analytes; the ions are then separated based on their mass-to-charge ratios by a mass analyzer, and detected by a detector. There are many different techniques for ionizing samples, such as electrospray ionization (ESI), chemical ionization (CI), photoionization (PI), inductively coupled plasma (ICP) ionization, and matrix assisted laser desorption ionization (MALDI). Although all the techniques listed above share a common aspect, that a solid or liquid sample must be converted to a plume of molecules, atoms or ions, their mechanisms of ionization differ. As a result, the compounds that can be ionized by each of these techniques are not identical.

In the earliest implementation of electrospray, a sample plume was sprayed into a high electrical field without pneumatic or ultrasonic nebulization. This is referred to as "pure electrospray." Pure electrospray had the problem of low flow capabilities (0.1 to 10 μl per minute). Therefore, it was difficult to use pure electrospray with liquid chromatography (LC), which has a much higher flow rate (typically up to 2 ml per minute). When the electrospray flow rate is above 100 μl per minute, it is usually impossible to maintain a sample plume, due to unstable spray formation. The ionization efficiency of pure electro spray thus decreases at higher flow rates, and sensitivity is completely lost at typical chromatographic flow rates. Therefore, the interface between LC and pure electrospray routinely splits the sample flow by a factor of 10 or more, sacrificing sensitivity, resolution and reproducibility.

The development of pneumatically assisted electrospray (or "ion spray"; see, e.g., U.S. Pat. No. 4,861,988) alleviated the flow limitation to some extent. This technique employs a concentric nebulizing gas around the central liquid delivery capillary, and enables a flow rate up to several hundred micro liters per minute, with a moderate loss of sensitivity. As discussed below, various improvements have been made to this technique.

A few years after U.S. Pat. No. 4,861,988, a heater was mounted directly on the pneumatic sprayer to assist ionization with heat and heated gas. This thermally assisted electrospray interface improved sensitivity by three times, and a flow rate of up to 500 μl per minute was demonstrated (U.S. Pat. No. 4,935,624). However, the heated nebulizer was prone to sample degradation and clogging, due to difficulty of regulating the temperature at the tip of the nebulizer.

Another implementation (Vestal, 1992) used moderately heated concentric air to assist ion formation within the electrospray plume, but, because the sprayer was deeply buried inside the concentric heated chamber, adjustment or service of the sprayer region was difficult.

At about the same time, U.S. Pat. No. 5,352,892 disclosed another way of heating the spray plume, wherein a heated disk with a central opening was placed in between a pneumatically assisted electrospray nebulizer and the ion sampling inlet to a mass analyzer. In this arrangement, a fraction of the nebulizing gas would be preheated at the opening of the heated disk body. This heated gas was then remixed with the central portion of the spray plume prior to the ion sampling inlet. In this device, heat transfer was sufficient to achieve ion formation at flow rates as high as 2 ml per minute, but the drawback was contamination of the heated disk, which required frequent cleaning.

In a design described in U.S. Pat. No. 5,412,208, the nebulization and ion sampling process was assisted by preheated gas that intersected the flow of the nebulized sample. This turbulent mixing helped to evaporate droplets of the sample, as well as push the electrospray plume in the direction of the ion sampling inlet. The main disadvantage of this design is non-uniform and limited heat exchange between the heated gas flow and the ESI plume. A newer design, described in U.S. Pat. No. 6,759,650, used two heated gas flows that intersected with the sample flow to promote turbulent mixing, but the design was complicated and less cost effective.

U.S. Pat. No. 5,495,108 discloses an ion source in which a heated drying gas is directed to a spray plume that is orthogonal to the ion sampling inlet. For example, the ion sampling inlet 236 may be positioned at 90 degrees with respect to the direction of nebulization (FIG. 2). A liquid sample 224 is delivered though a stainless steel grounded tube 226, while nebulizing gas 222 is supplied through a concentric grounded tube 228. A heated drying gas 234 is partially diverted through a special conduit 235 to deliver about 1 liter per minute of highly heated gas into the pneumatically assisted electrospray plume 237, with an overlapping ark section 243 to assist droplet evaporation and ion formation at higher sample liquid flow rates (up to 1 ml/min). The main opening 241 for the heated drying gas, defined by spray shield 238, delivers the gas at a flow rate up to 12 liters per minute. A Faraday cage electrode 239 provides a high voltage electrical field.

Another design, described in U.S. Pat. No. 7,199,364, includes a second, laminar gas flow that is heated, wherein the nozzle for the second gas flow is behind the nebulization nozzle in a semi-circular pattern. This design achieved limited heat transfer and only a moderate improvement in sensitivity.

In summary, there is a constant need for further improvements in ion source design and higher ionization efficiency.

BRIEF DESCRIPTION OF THE DRAWINGS

FIG. 9 shows the shape of peaks in the chromatographic ion trace obtained using the source shown in FIG. 2 (FIG. 9*a*, peak 94) as compared to the source shown in FIG. 7 (FIG. 9*b*, peak 92).

FIGS. 12-15 show the results of LCMS analysis of various compounds. The effects of the ion source described in FIG. 7 ("AJS"), atmospheric pressure chemical ionization ("APCI"), and ESI/CI multimode ("MM") are compared. The y-axis indicates LC peak area. The temperature indicates the sheath gas temperature set point in the user interface which roughly approximates the sheath gas temperature at the nozzle exit.

DESCRIPTION OF THE INVENTION

Figure 1:
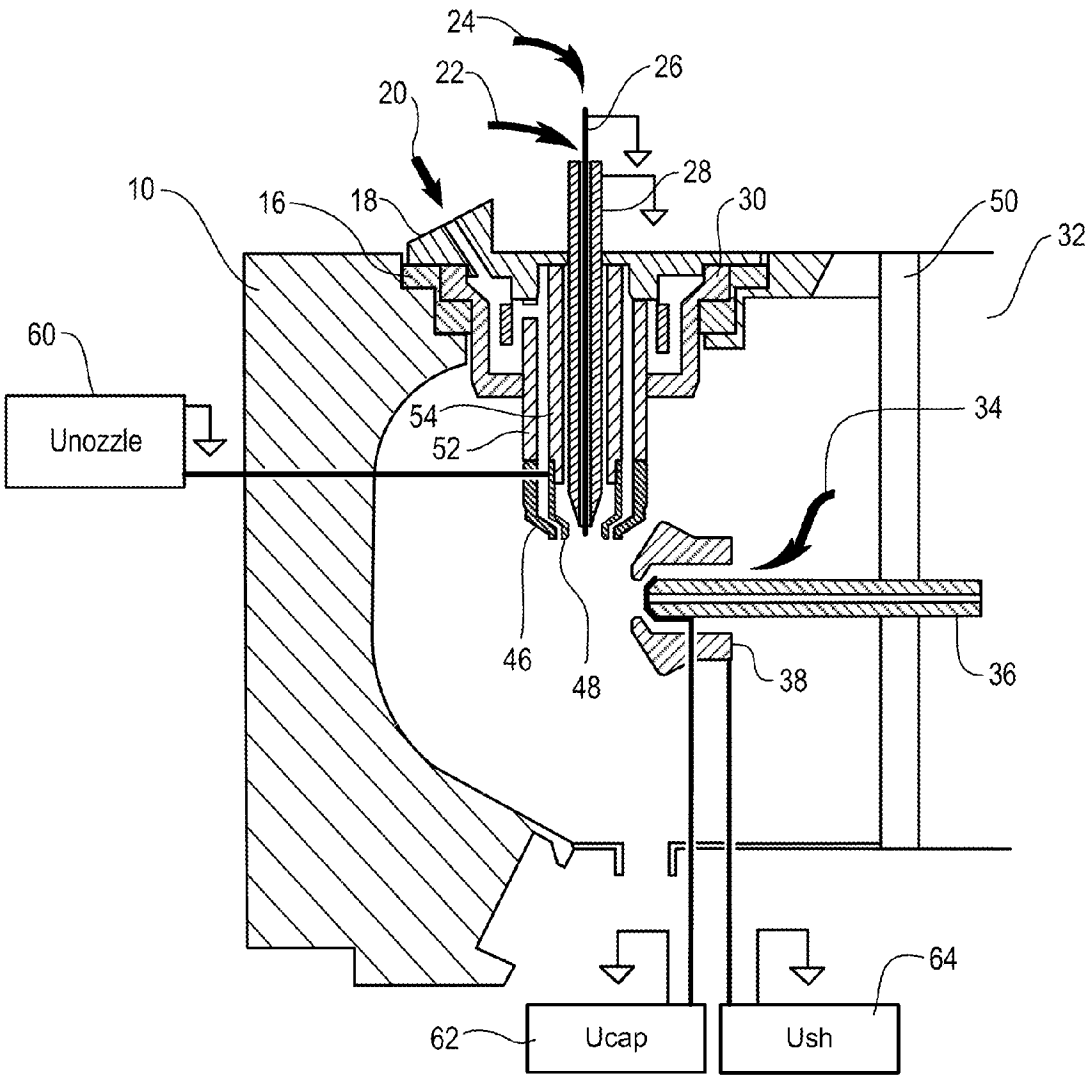
FIG. 1 shows some of the features of certain embodiments according to the present invention. These embodiments do not include a Faraday cage.

This invention provides, inter alia, ion sources that generate significantly higher ion density. Furthermore, the resulting ion distribution maintains sharp and non-tailing chromatographic peaks, indicating uniform ion formation and better resolution among different analytes. In some embodiments, the ion source comprises a capillary for sample intake from one end and spraying the sample into droplets from the other end. The droplets, along with a first gas that is supplied to a location near the droplets, form a plume, which is confined by the flow of a second, heated gas. The heated gas can be delivered in close proximity to the spray end of the capillary, resulting in flash vaporization of the sprayed droplets in a confining flow of heated gas. In some of the embodiments, the nozzle that releases the heated gas is electrically connected to a power supply, and is capable of providing an electrical field at the spray end of the capillary. When solvents are removed from the droplets, the analytes in the droplets become ions. The nozzle can comprise multiple electrodes, and different parts of the nozzle may operate at different electrical potentials, but the combined effects, along with other electrical forces in the ion source, can result in an electrical field to charge at least some of the droplets. In some embodiments, the capillary and/or the tube for supplying the first gas are at ground potential, and are thus safer for the user to handle.

In some embodiments, the ion source comprises a heat shield between the second, heated gas and the first gas. In some of the embodiments, the heat shield is heat-conductive and configured to transmit heat away from the ion source, thus the heated gas can be heated to a higher temperature without damaging other parts of the ion source. For the same reason, the heated gas can be located closer to the sample intake capillary without thermally degrading the sample in the capillary.

In some embodiments, the first and second gas flows are both parallel to, or even concentric with, the capillary. In some embodiments, the first or second gas is directed at a point some distance beyond the end of the capillary. Thus, the first gas flow or the second, heated gas flow meets the flow of the sample at an angle. In some other embodiments, the first and second gas flows are parallel to the flow of the sample.

Prior to describing the invention in further detail, the terms used in this application are defined as follows unless otherwise indicated.

The details of one or more embodiments of the invention are set forth in the accompanying drawings and the description below. Other features, objects, and advantages of the invention will be apparent from the description and drawings, and from the claims.

Definition

It should be noted that, as used in the specification and the appended claims, the singular forms "a," "an" and "the" include plural referents unless the context clearly dictates otherwise. Thus, for example, reference to "a mass analyzer" includes combinations of mass analyzers, and reference to "a tube" includes combinations of tubes, and the like.

An "electrospray ion source" is a device that can ionize a sample by electrospray. In an electrospray process, a liquid sample containing analytes is sprayed into droplets. The droplets are subjected to an electrical field, and at least some of the droplets are electrically charged. Upon removal of solvent from the droplets ("desolvation"), some of the analytes in the charged droplets become ionized.

As used herein, when a part (part A) "surrounds" another part (part B), part A appears in all or almost all directions of part B, although holes or gaps may exist (partial surrounding, see below). Surrounding may be direct or indirect, and complete or partial. For example, if a layer surrounds a tube, the layer may be in contact with the tube (surrounding directly), or it may be separated from the tube by at least one object or space (surrounding indirectly). Furthermore, the layer may completely surround the perimeter or length of the tube, or it may surround the tube only partially lengthwise and/or circumferentially. When part A does not completely surround part B circumferentially, at least 55, 60, 65, 70, 75, 80, 85, 90, 91, 92, 93, 94, 95, 96, 97, 98, or 99% of the perimeter of part B should be surrounded.

A "nebulizing gas" is a gas used to help a liquid to form an aerosol. The gas is preferably an inert gas, usually nitrogen.

As used herein in the context of mass spectrometry, "atmospheric pressure (AP)" is a pressure above the vacuum level, usually between about 100 Torr and about twice the local atmospheric pressure, or higher.

Exemplary Ion Sources and Methods of Use

Figure 3:
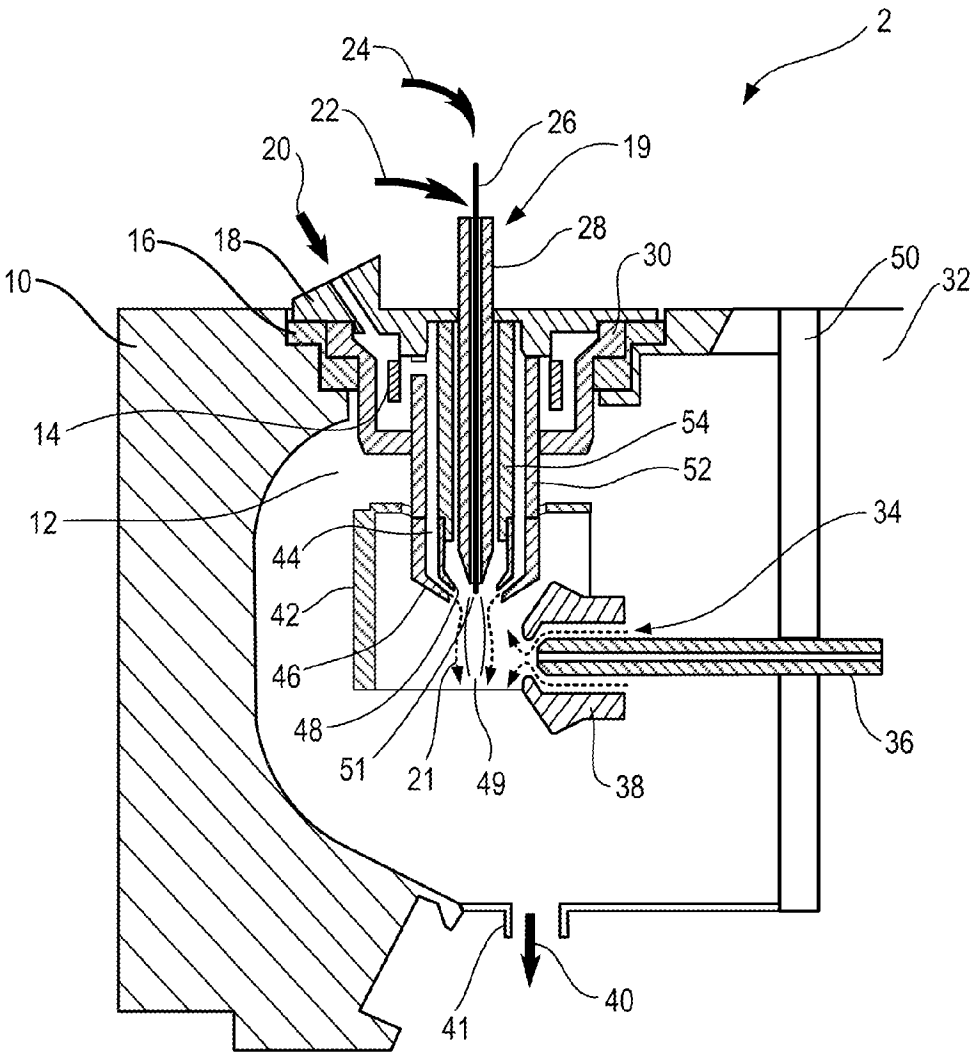
FIG. 3 shows some of the features of certain embodiments according to the present invention.

FIG. 3 shows a cross section of one embodiment of the present invention. The ion source 2 of this embodiment has a housing 10, which surrounds a chamber, in this case an atmospheric pressure region 12. The atmospheric pressure region 12 is separated from a first stage vacuum region 32 of a mass spectrometer by a wall 50. A liquid sample is introduced into a nebulizer 19 through a capillary 26 as illustrated by the arrow 24. The sample can be sprayed from the delivery end of the capillary 26 (spray tip 51) into the chamber 12. A first, nebulizing gas flow is introduced concentrically around the capillary 26 via tube 28 as illustrated by the arrow 22. A second gas, or sheath gas, is also introduced concentrically around the nebulizer 19 via a port 18 and through a heater chamber housing 30 into a concentric tubular opening 44 formed by tubular electrical insulators 52 and 54 and exiting to the ion source chamber 12 though a concentric metal nozzle formed by conical tubes 46 and 48. The arrow 20 illustrates the sheath gas supply which is connected to the ion source through the gas port 18. The sheath gas nozzle elements 46 and 48 are connected to electrical high voltage power supplies to provide a charging electrical field at the tip of the nebulizer formed by capillary 26 and tube 28. The combined effect of the charging field, the nebulizing gas 22 and the sheath gas 21 results in the focused electrospray plume 49 of highly charged sample analyte confined within sheath gas flow 21. Preferably, for most efficient confinement of the plume, turbulence should be minimized. In some embodiments, the sheath gas is heated by the optional heater 14, which is located within the heater chamber housing 30. In some other embodiments, pre-heated sheath gas is introduced as indicated by arrow 20 into the ion source 2. A thermal and/or electrical insulator 16 insulates the housing 10 from the heater chamber housing 30.

Thus, one aspect of the present invention provides a device comprising:

a housing that defines a chamber;

a capillary having a receiving end and a delivery end, wherein a liquid sample can be received from outside of the chamber through the receiving end and sprayed into droplets out of the delivery end in the chamber;

a tube surrounding the capillary for transmitting a first gas to a location near the delivery end of the capillary;

a conduit surrounding the capillary for transmitting a second, heated gas;

wherein the heated gas is released into the chamber by a nozzle, said nozzle comprising at least one electrode to which a potential can be applied, which contributes to the generation of an electrical field at the delivery end of the capillary. The electrical field is capable of charging at least some of the droplets, and upon desolvation of the charged droplets, analytes in the sample can become ionized. The potential applied to the nozzle contributes to this electrical field and enhances or suppresses droplet charging according to the user's preference. In some embodiments, the ion source is configured so that the potential applied to the nozzle is tunable, and the user may tune the potential to optimize ionization of different classes of analyte compounds. In some other embodiments, the nozzle may be maintained at a fixed potential or connected to ground. As explained in more detail below, the tube and the first gas (nebulizing gas) are optional.

It is contemplated that the description above encompasses the embodiments in which the tube is a group of tubes which collectively surround the capillary and transmit the first gas. Similarly, the conduit may be a group of conduits which collectively surround the tube and transmit the heated gas. Furthermore, as illustrated in FIG. 3, an insulator layer may define part of the conduit for transmitting the heated gas in some embodiments. The insulator layer can be electrically-insulating, heat-insulating, or both. In some embodiments, the tube for the first gas and the conduit for the second gas are separated by a space. The air in this space can help to insulate the first gas and sample capillary from the second, heated gas and electrical potential provided by the nozzle. The insulator layer and the space can be combined for additional protection. Other variations are disclosed herein or apparent to people of ordinary skill in the art.

It should be noted that the flows of the sample (in capillary 26), the first gas (in tube 28), and the sheath gas (between nozzles elements 46 and 48) can be concentric. In some other embodiments, the flows may have parallel axes but not concentric. In some embodiments, the sprayer tip 51 is positioned approximately flush with the opening of the nozzle elements 46 and 48. It is possible to position the sprayer tip 51 slightly extended beyond the opening of the nozzle elements 46 and 48, which may affect the strength of the charging field. It is also possible to position the sprayer tip 51 slightly recessed from the nozzle opening; however, this may result in sample deposition on to the internal nozzle surfaces, which may increase the required cleaning frequency.

In some embodiments, the exit region between the inner nozzle element 48 and outer nozzle element 46 is angled. The angle, as defined by the smallest angle between a hypothetical line extended from the end part of nozzle element 46 and a hypothetical line extended from capillary 26, is typically 50 degrees or less, such as 50, 45, 40, 35, 30, 25, 20, 15, 10, 5 degrees or less. An angle of 0 degrees would deliver a parallel flow. It should be noted that a divergent flow (negative angle) can be used in the devices of the present invention as well. Such a flow is still confining, but does not focus the plume very much. In some cases, a positive angle will direct the gas flow to a region below the spray tip 51 (as illustrated in FIG. 3). For example, the region can be about or less than about 12, 11, 10, 9, 8, 7, 6, 5, 4, 3, 2 or 1 mm below spray tip 51.

In some other embodiments, the nozzle elements 46 and 48 are both parallel to the capillary 26 in the exit region (as illustrated in FIG. 1), and the flow of the sheath gas is parallel to that of the sample. Although this configuration is only illustrated in FIG. 1 and FIG. 7, it can be used in any other embodiment of the present invention. Similarly, the configuration illustrated in FIG. 3 can also be used in any other embodiment of the present invention. Note that other designs of the nozzle can also be used, which are known in the art or apparent from knowledge in the art.

The sizes of the parts can be decided according to knowledge in the art, economic concerns, and goal of the user. In many embodiments, the inside diameter (ID) of the inner or outer nozzle element (46, 48) is 2-25 mm, particularly 2-5 or 5-10 mm. For example, the ID of the inner nozzle element 48 can be 7 mm. The outside diameter (OD) of the inner nozzle element 48 can be 8 mm and the ID of the outer nozzle element 46 can be 9 mm, providing a 0.5 mm circular opening for the sheath gas. These dimensions were chosen to be relatively small to minimize sheath gas flow and maximize the effect of the charging field generated by the nozzle electrodes. In general, when the ID of the nozzle is decreased, there is a higher chance of bringing the heated sheath gas into proximity of the spray tip 51, resulting in undesired sample boiling and signal drop outs. However, as described herein, this invention provides multiple features to insulate the sample from the nozzle and the sheath gas thermally, electrically, or both. Therefore, the nozzles can be brought close to the sample capillary. In some embodiments, the distance between the spray tip 51 and the nearest part of the nozzle releasing the sheath gas is less than about 10, 9, 8, 7, 6, 5, 4, 3, or 2 mm, a feature that could not be achieved by prior devices without thermally degrading the sample or causing arching. Since these embodiments allow high-temperature sheath gas and close proximity between the sheath gas and the sample, flash vaporization of the sample and a confined plume can be achieved.

In some embodiments, the sheath gas flows quickly as a jet stream. Thus, the velocity of the sheath gas, in some embodiments, can be about 35-55, 25-60, 25-80, or 15-70 meters per second. For example, the velocity can be 35, 40, 45, 50, 55, or 60 meters per second. The velocity can also be lower or higher as decided by the user.

The ion source may further comprise an inlet to a mass spectrometer or an ion mobility separating device. The inlet may be any structure known or apparent in the art. Exemplary inlets include, without being limited to, an orifice, a short tube, and a capillary. The MS inlet in FIG. 3 includes an ion transfer glass capillary 36 with a metalized front end and a spray shield 38, which delivers a third, heated gas 34 (the drying gas). The ion transfer capillary 36 is substantially orthogonal to the sample capillary 26 in FIG. 3. However, the ion transfer capillary 36 can be positioned in any orientation relative to sample capillary 26. The ion transfer capillary 36 connects the atmospheric pressure region 12 and the first vacuum region of the mass spectrometer 32. The sprayed sample is partially transferred to the mass spectrometer through the capillary 36 while a portion of the sample as well as all additional gas flows exit the sealed ion source chamber 12 through a port 41 as illustrated by the arrow 40.

Figure 7:
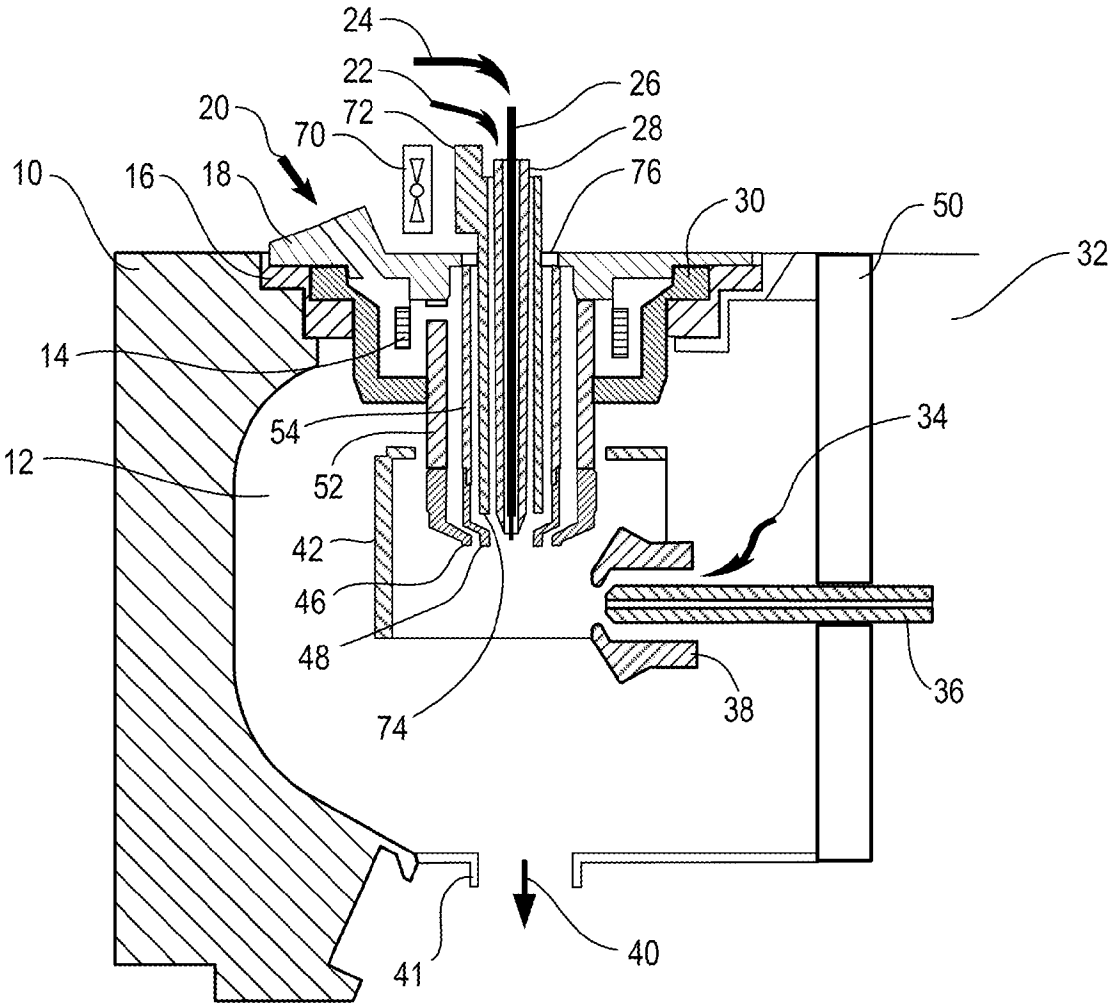
FIG. 7 shows some of the features of certain embodiments according to the present invention. The features include a heat shield (part 74).

FIG. 7 shows another embodiment of the present invention. In this embodiment, an additional heat shielding layer is incorporated into the ion source. The heat shielding layer is shown as a thermally conductive tube 74 that surrounds the concentric nebulizing gas tube 28, but other shapes and configurations are also possible to achieve the purpose of shielding the sample capillary and nebulizing gas tube from heat, as well as actively transmitting heat away. Tube 74 is sealed at the top of the ion source chamber with a washer 76 that is made out of a heat insulating material to prevent conductive heat transfer to tube 74 from the heater chamber housing 30. The heat shielding layer can act as a heat sink and actively dissipate heat. In some embodiments, the heat shielding layer can be connected to housing 10, and the housing can optionally be subject to a cooling mechanism. In the embodiment shown in FIG. 7, the thermally conductive tube 74 is connected to a heat sink 72, which is positioned outside of the ion source chamber and preferably cooled by forced air produced by a fan 70. It is worth noting that passive air cooling of the heat sink 72 can also be used given sufficient surface area for the heat sink 72. The thermally conductive tube 74 provides effective shielding of the concentric nebulizing gas tube 28 from both radiative heat transfer and convective heat transfer from the tubular insulator 54 and heated nozzle element 48. The tube 74 preferably covers almost the entire length of the sample capillary 26, and should extend as close to the delivery end of capillary 26 as possible, as long as no arching would result due to proximity to the nozzle 46/48.

With the presence of the heat shielding layer, it is possible to increase the temperature of the sheath gas above 250° C., such as up to about 400° C. (measured where the sheath gas is released from the nozzle to the chamber), without boiling the sample in the tip of the nebulizer. In fact, the sheath gas temperature may be even higher if the sample solvent is less volatile (such as aqueous) and provides more protection to the sample from boiling. Note that the sheath gas cools down in the conduit before it reaches the nozzle, so the gas can be heated to a temperature significantly higher than 400° C. (for example, 500° C. or above) by heater 14 or as a pre-heated gas in order to be released to the chamber at about 400° C. The actual temperature decrease in the conduit should be determined by the user, as it depends on many factors, including the length of the conduit, the material of the parts, and the speed of the sheath gas flow.

In some embodiments, the heat shielding layer (such as the thermally conductive tube 74) comprises a copper layer that is coated with an inert material or a material with low surface emissivity. For example, gold has low surface emissivity and tends to reflect heat rather than absorbing it, and this property helps to prevent heat transfer from the heated gas to the sample capillary. In addition, gold is chemically inert and capable of protecting copper from oxidation, erosion, or other damages. Other low-surface emissivity, inert materials include, without being limited to, platinum, rhodium, and titanium nitride.

In addition to or in lieu of the heat shielding layer described above, the ion source may comprise a space between the nebulizing gas tube and the sheath gas conduit. In some embodiments, the space may be optionally connected to a cooling gas supply to run a cooling gas through the space, which helps to remove the heat from the nebulizer. In the embodiments wherein there are both a heat shielding layer and a space, any combination of these parts can be employed, for example, nebulizer-heat shielding layer-space-sheath gas conduit, nebulizer-space-heat shielding layer-sheath gas conduit, nebulizer-space-heat shielding layer-space-sheath gas conduit, and the like.

Another cooling tool that can be included in the heat shielding layer or the space is a heat pipe, which comprises a liquid that undergoes phase change at a relatively low temperature, e.g., 60° C. The liquid can be sealed in the space or the center of the heat shielding layer. When the liquid is heated near the phase change temperature, many bubbles are formed and flow upwards, while the remaining liquid flows down, resulting in vigorous mixing and heat exchange. The upper part of this reservoir can be connected to a heat sink, cooled by a fan, or the like, to increase the heat exchange.

Figure 4:
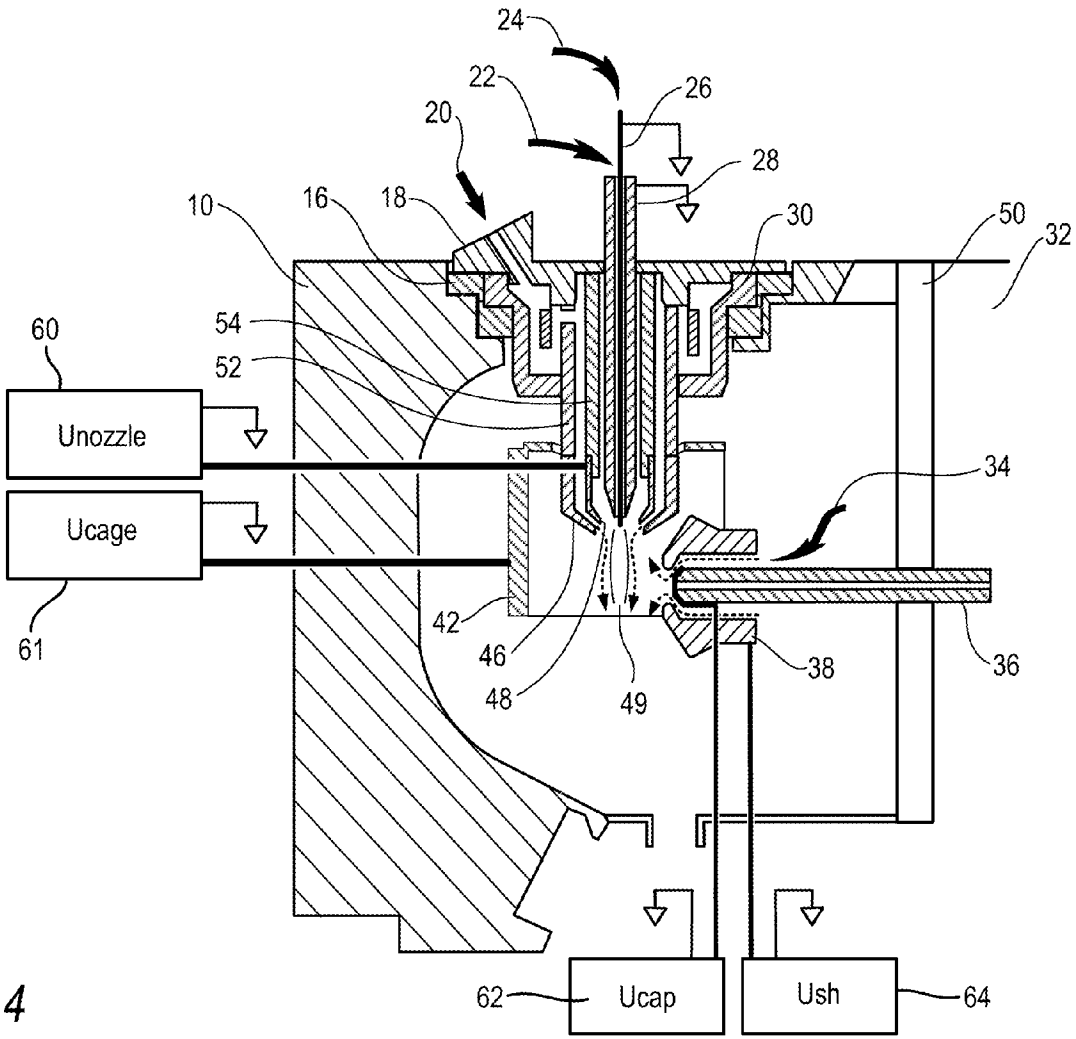
FIG. 4 shows the connection of electrical power supplies in some embodiments of the present invention.

FIG. 4 shows the connection of electrical power supplies in some embodiments of the present invention. In these embodiments, the sample delivery capillary 26 as well as the nebulizing gas tube 28 are grounded, while power supply 60 provides voltage potential Unozzle (V) to the nozzle formed by the outer nozzle element 46 and inner nozzle element 48. The spray shield 38 is connected to the power supply 64, while the ion transfer capillary 36 front end is connected to the power supply 62. The spray plume 49 is also surrounded by a Faraday cage 42 which is connected to the power supply 61. It should be noted that all voltages are relative and can be floated. For example, the sample delivery capillary 26 can be at a high voltage, while the spray shield and/or ion transfer capillary are near ground potential.

Figure 5:
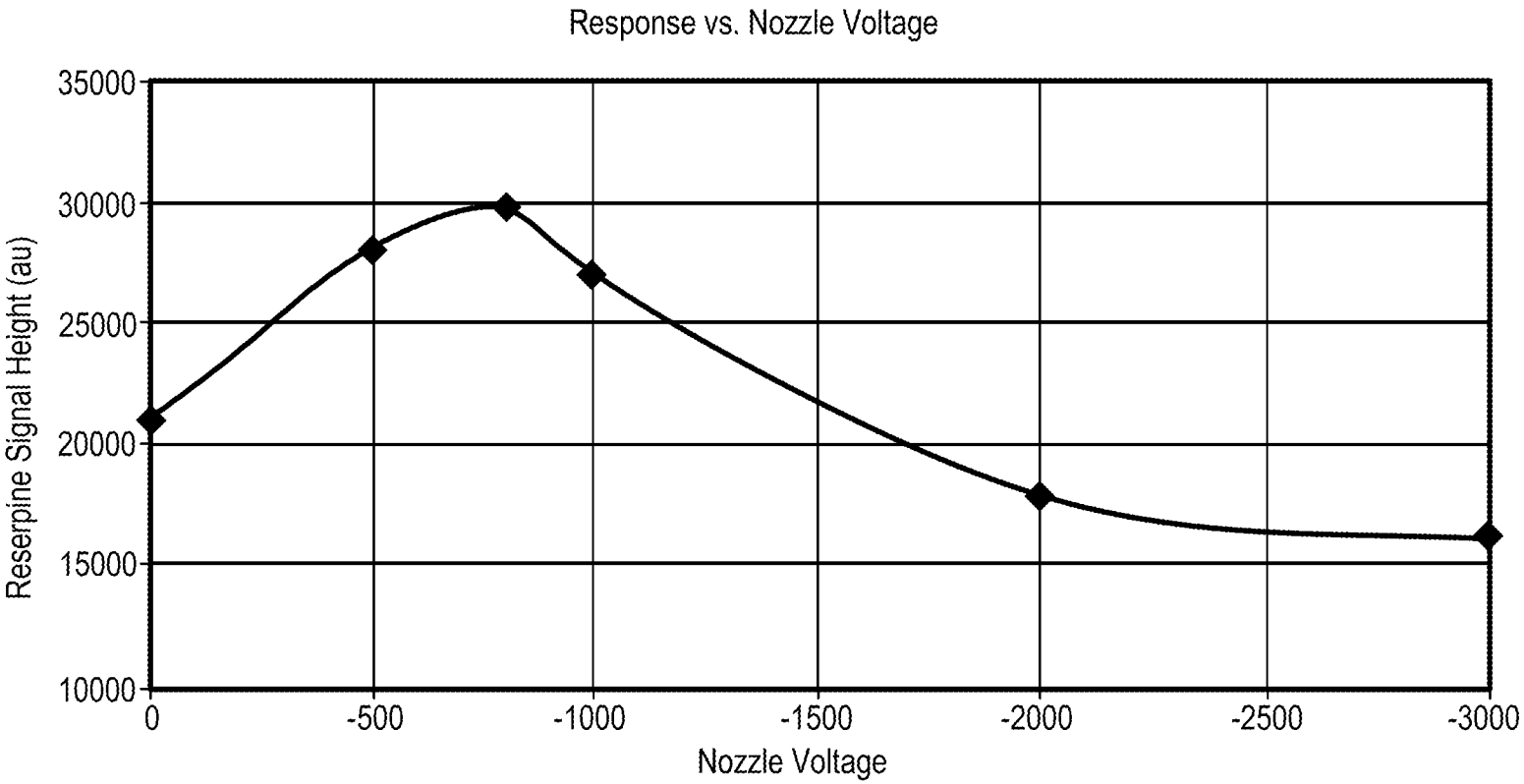
FIG. 5 shows the observed relationship between signal height and nozzle voltage using reserpine as the analyte.
Figure 6:
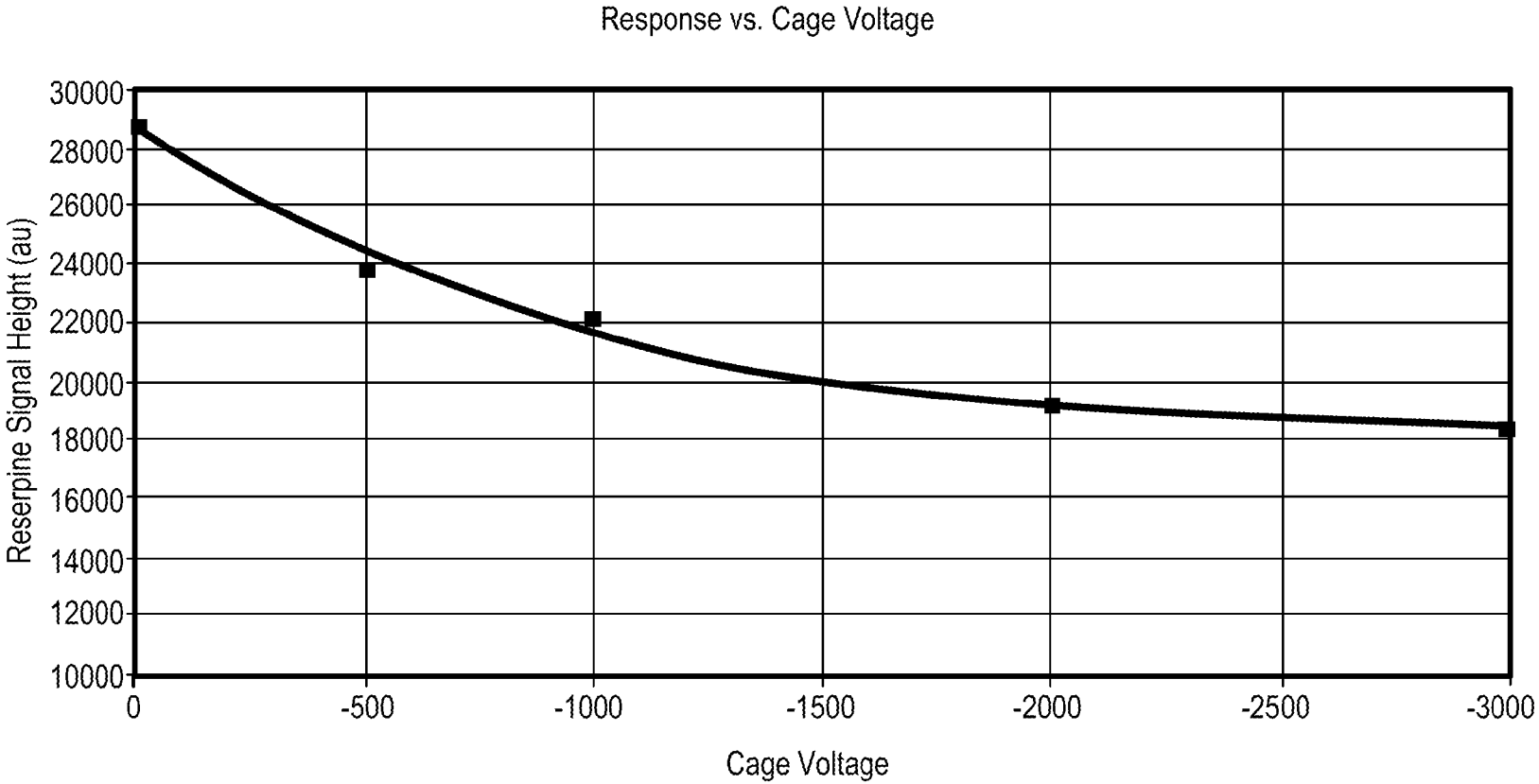
FIG. 6 shows the observed relationship between signal height and cage voltage using reserpine as the analyte.
Figure 8:
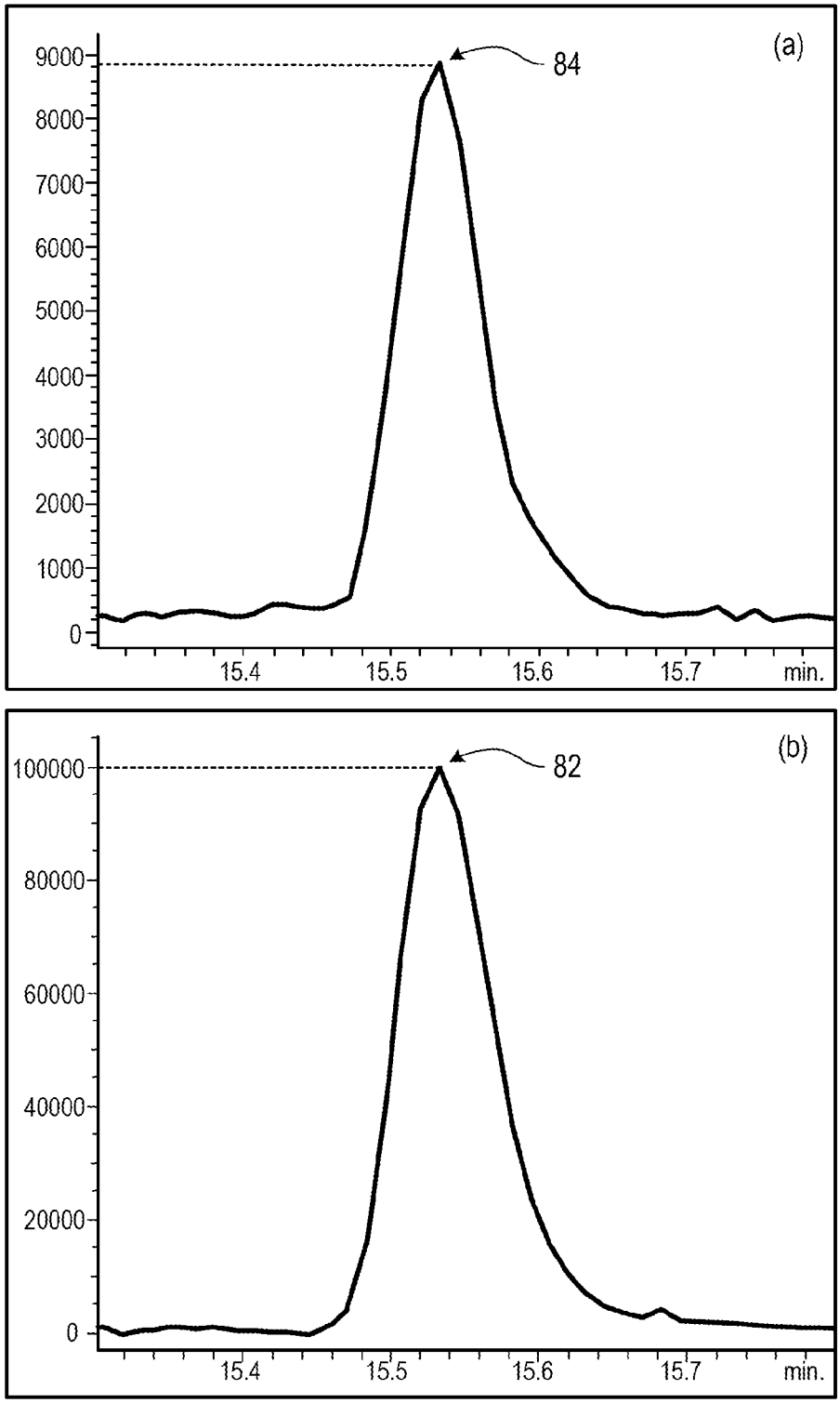
FIG. 8 shows the relative change in the positive ion current from the protonated molecular ion of reserpine (m/z=609) analyzed by LC/MS using the ESI source shown in FIG. 2 (FIG. 8*a*) as compared to the source shown in FIG. 7 (FIG. 8*b*).

All voltages can be optimized for maximum amounts of ions delivered to the mass spectrometer. For example, FIGS. 8*a* and 8*b* show the relative change in the positive ion current from the protonated molecular ion of reserpine (m/z=609) analyzed by LC/MS at a flow rate of 400 μL/min using 75% methanol, 25% water with 5 mM ammonium formate. FIG. 8*a* was obtained using the ESI source shown in FIG. 2, while FIG. 8*b* was obtained using a source of the present invention as shown in FIG. 7. The temperature of the sheath gas was 330° C. at 11 L/min, the drying gas was set at 300° C. at 4 L/min, and the nebulizing gas pressure was maintained at 20 psi. The plot on FIG. 5 shows that the signal clearly peaked at a nozzle voltage around minus 800V. The spray shield voltage, the cage voltage and the ion transfer capillary voltage were optimized at −3500V, 0V, and −4000V, respectively. The signal dependence on the nozzle voltage is relatively strong, but it optimizes at a surprisingly low voltage between −500V and −1000V in the experiment shown in FIG. 5. It may be attributed to the fact that voltage potential applied to the spray shield generates sufficient electrical field at the tip of the nebulizer for effective ionization. In a separate experiment in which the temperature of the sheath gas was higher, the nozzle voltage optimized at an even lower voltage between 0 and −500V (data not shown). Another surprise is the relatively low Faraday cage 42 voltage (i.e. the maximum of the signal is actually achieved close to zero voltage on the Faraday cage electrode) and very low dependence of the ion signal on the cage voltage, as revealed by FIG. 6. It is interesting to note that another optimum in signal intensity was achieved with the spray shield, nozzle, cage, and capillary potentials at −3500V, 0V, 0V, and −4000V respectively.

At present, the reasons for these observations are not well understood, but without limiting the invention, it appears there may be different dynamics for ion formation from the droplets when the spray plume is confined by a sheath gas at elevated temperatures. The electrospray plume under operating conditions appears much more confined, focused and compressed in the radial dimension. Without limiting the scope of invention, this potentially can be attributed to the thermal gradient focusing that can be described as the balance of heat transfer to the border between the condensed phase plume and the encompassing heated sheath gas. Heat flow (Q) to the plume is proportional to the temperature difference ($\Delta T$) between the sheath gas and the boiling temperature of the liquid in the condensed phase within the plume. Heat flow (Q) is proportional as well to the total area (S) of the condensed phase plume.

$$Q \sim \Delta TS \quad (1).$$

At the same time, Q is constant and is equal to the total heat needed to evaporate the sprayed condensed phase, thus resulting in an inversely proportional relationship of the total condensed phase plume area (S) vs. $\Delta T$. Depending on the particular plume geometry, which can range from spherical to cylindrical, the surface area (S) is either proportional to $R^2$ or to the first degree of R, where R is the characteristic radial dimension of the sprayed condensed phase plume. Thus Equation (1) can be rewritten as:

$$R \sim 1/\Delta T^{\alpha} \quad (2),$$

where $\alpha$ is between 0.5 and 1 depending on the particular spray plume geometry. Equation (2) describes the observed focusing of the sprayed condensed phase plume in the radial dimension with increased sheath gas temperature. A tighter, more focused spray can result in higher droplet concentrations and therefore higher ion concentrations at the border of the spray, thus resulting in the enhanced sensitivity observed in the device of the present invention.

Figure 2:
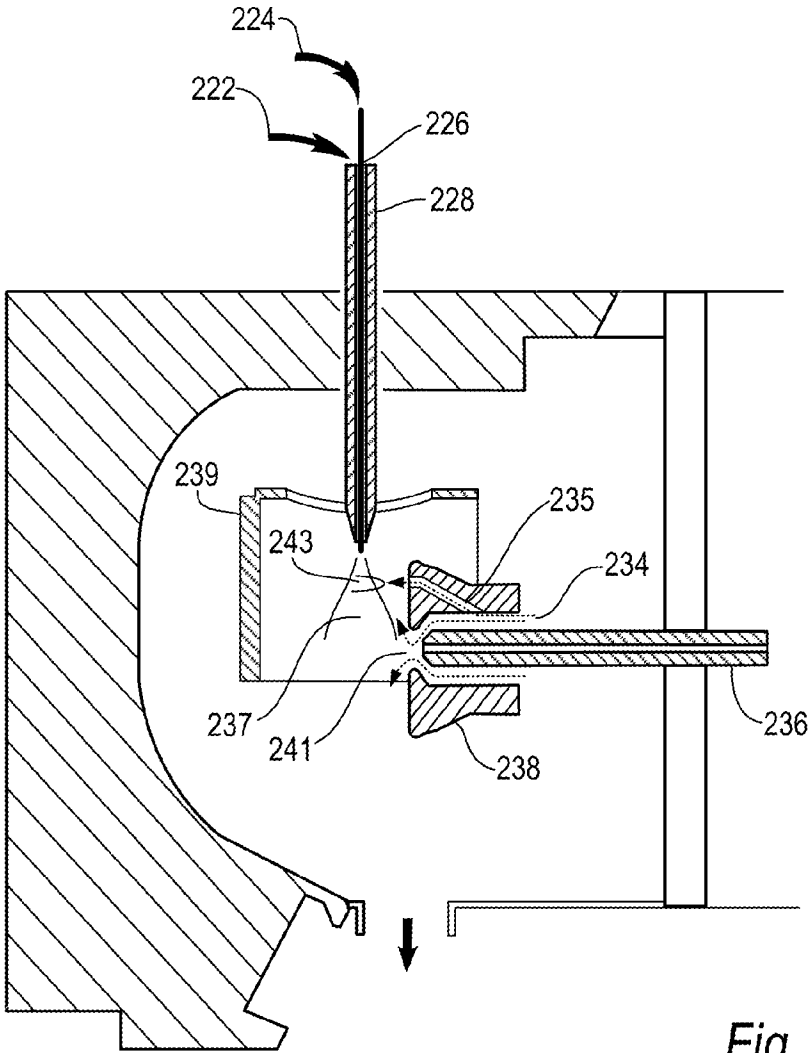
FIG. 2 shows the design of a previously-known ion source.

The absolute intensity of peak 82 (FIG. 8*b*) demonstrates an 11.6-fold increase in signal, which is proportional to ion current, using an ion source of the present invention versus the absolute intensity of peak 84 (FIG. 8*a*) which was obtained using a prior art ESI ion source as shown in FIG. 2 on a commercially available 6130 MSD from Agilent Technologies (www.agilent.com). Both chromatographic ion traces were obtained using the same amount of injected sample (50 pg of reserpine) under identical chromatographic conditions at a flow rate of 400 μL/min as described earlier. Comparing the calculated area of peak 82 (FIG. 8*b*) with the calculated area of peak 84 (FIG. 8*a*) yields a relative increase of 13-fold without a significant increase in peak tailing.

FIGS. 9*a* and 9*b* illustrate an additional advantage of the source of the present invention, which is the ability to maintain sharp, non-tailing chromatographic peaks. Peak 94 (FIG. 9*a*) shows a chromatographic ion trace obtained using a prior art ESI source as shown in FIG. 2, while peak 92 (FIG. 9*b*) shows a chromatographic ion trace obtained using an ion source of the present invention as shown in FIG. 7. Both ion traces were obtained using the same amount of injected sample (100 pg caffeine) under identical chromatographic conditions at a flow rate of 400 μL/min using 75% methanol, 25% water with 5 mM ammonium formate. The full width at half maximum (FWHM) for the caffeine ion trace (peak 92) using an ion source of the present invention is 10% narrower while the absolute intensity is 4 times higher compared to the ion trace (peak 94) obtained using a prior art ESI source. This result is quite remarkable, since caffeine is often difficult to analyze due to its relatively low molecular weight, sample volatility and ease of degradation at elevated temperatures.

FIG. 1 shows another embodiment of the present invention, wherein the Faraday cage (FIG. 7, item 42) and corresponding power supply (FIG. 4, item 61) are omitted. This embodiment has cost advantages and is based on the fact that the cage voltage of the present invention as shown in FIG. 7 was optimized close to ground potential. This is not entirely surprising if we consider the electrostatic potential provided by the nozzle (46 and 48 of FIG. 4) as being analogous to the cage potential of FIG. 2, item 39.

Figure 10:
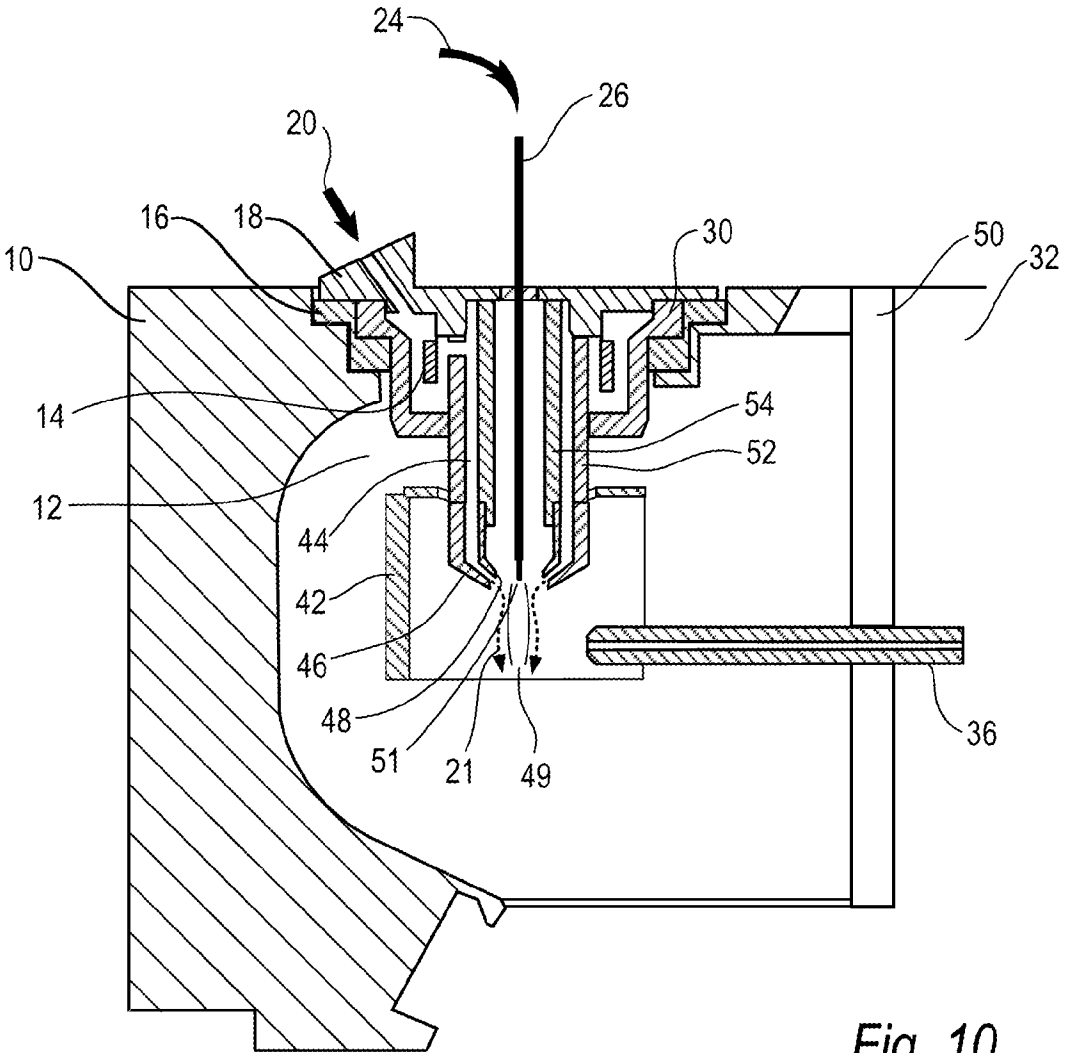
FIG. 10 shows some of the features of certain embodiments according to the present invention. These embodiments ionize analytes with "pure electrospray," without pneumatic or ultrasonic nebulization.

Additional embodiments of the present invention could be extended to low flow ESI ion sources that operate in a "pure electrospray" mode (no pneumatic or ultrasonic nebulization) such as the Nanospray Source or the HPLC-Chip MS Interface from Agilent Technologies (www.agilent.com). FIG. 10 illustrates such an embodiment, where the liquid analyte 24 is introduced into a capillary 26 at flow rates up to 5 μL/min. The capillary 26 is not limited to a cylindrical geometry. The HPLC-Chip from Agilent Technologies is an example of an alternate geometry for the capillary 26. In some embodiments, the capillary 26 is at ground potential and the nozzles 46 and 48 are connected to high voltage power supply as in FIG. 4. The ion source chamber 12 is sealed with the only exit being through the ion transfer capillary 36 into the first vacuum region of the mass spectrometer 32. There is no drying gas (compare to 34 of FIG. 3), and the typical flow rate of the heated sheath gas 20 is set to, for example, 1 L/min. It is also understood that the capillary 26 need not be limited to an orthogonal orientation with respect to the ion transfer capillary 36. For example, an on axis orientation is conceivable.

Figure 11:
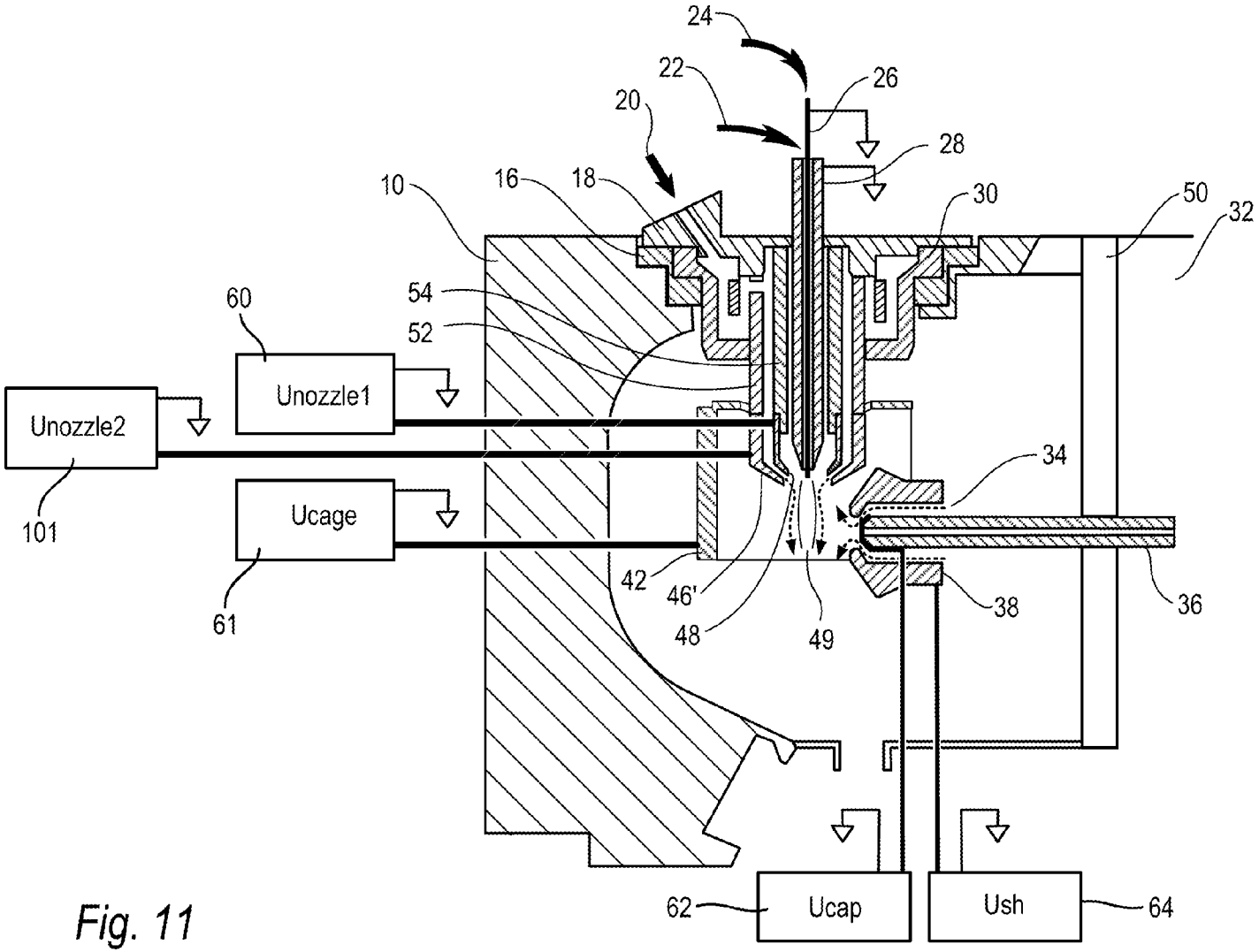
FIG. 11 shows some of the features of certain embodiments according to the present invention, wherein different elements of the nozzle are configured to operate at different electrical potentials.

It is also recognized that in some embodiments, running the nozzle elements 46 and 48 at different potentials can further optimize droplet charge density and ion transport, as illustrated in FIG. 11. In FIG. 11, nozzle element 48 is connected to power supply 60, providing voltage Unozzle1, and nozzle element 46' is connected to power supply 101, providing voltage Unozzle2. In some of the embodiments, the outer nozzle element 46' can be grounded and the inner nozzle element 48 can be connected to the power supply 60. Furthermore, modifications to the tip geometry of nozzle element 46' can also enhance droplet charge density and ion transport. For example, in the embodiment of FIG. 11, the edge of outer nozzle element 46' is flush with the edge of the inner nozzle element 48. In this case the potential of the inner nozzle element 48 defines the charging of the spray while the potential of the outer nozzle element 46 is shielded by the inner nozzle 48. However both potentials can be used to optimize ion collection within the ion spray chamber. For example, the potential of the outer nozzle element 46' can be used for steering the ions to the ion transfer capillary 36.

The ions sources of the present invention may be part of a larger system or device, such as a mass spectrometer system or an ion mobility spectrometer.

A mass spectrometer typically comprises an ion source, a mass analyzer, an ion detector and a data system. The ion source contains an ion generator which generates ions from a sample, the mass analyzer analyzes the mass/charge properties of the ions, the ion detector measures the abundances of the ions, and the data system processes and presents the data. Pumps for creating vacuum in certain parts of the system, and ion optics for directing the movement of ions, may also be included. The mass analyzer may be any mass analyzer (including mass filters), for example, a quadrupole, time-of-flight, ion trap, orbital trap, fourier transform-ion cyclotron resonance (FT-ICR), or combinations thereof. The mass spectrometer system may also be a tandem MS system, comprising more than one mass analyzer configured in tandem. For instance, the tandem MS system may be a "QQQ" system comprising, sequentially, a quadrupole mass filter, a quadrupole ion guide, and a quadrupole mass analyzer. The tandem MS system may also be a "Q-TOF" system that comprises a quadrupole and a time-of-flight mass analyzer. A particular class of MS systems is a combination of a mass spectrometer and an ion mobility spectrometer, comprising an ion mobility separating device and a mass analyzer in series. The mass spectrometer system may further comprise a sample separation device, such as a liquid chromatography column or a capillary electrophoresis device.

An ion mobility spectrometer typically comprises an ion source and an ion mobility separating device, such as a field asymmetric ion mobility spectrometer (FAIMS).

Surprisingly, it was discovered that the ion sources and methods of the present invention can be used to ionize many analyte compounds that have been considered not amenable to ionization by electrospray. In general, polar compounds are ionized more efficiently by electrospray, and less polar compounds are traditionally ionized by chemical ionization, because they do not respond well to electrospray. In the past, in order to ionize analyte compounds of a broader range, multimode ion sources were invented to ionize samples with two or more different mechanisms, such as an ion source having an electrospray portion and a chemical ionization portion that has a corona discharge needle (see, e.g., U.S. Pat. No. 6,646,257). However, our data shows that the ion source of the present invention can successfully ionize less polar compounds that are traditionally ionized by chemical ionization (Example 1).

Therefore, the present invention provides a method of generating ions from an analyte that is less polar and traditionally not amenable to electrospray ionization by using the ion sources described in this disclosure. In particular, ionization of these analytes can be achieved without adding a chemical ionization corona discharge needle or a UV light source.

The reason for this broader compound range is uncertain. Without wishing to be limited by a theory, we believe having a high charge density and a high temperature sheath gas contributes to efficient charge transfer at the border between the confined plume and the sheath gas.

ABBREVIATIONS

The following abbreviations have the following meanings in this disclosure. Abbreviations not defined have their generally accepted meanings.

| | |
|---|---|
| ° C. = | degree Celsius |
| hr = | hour |
| min = | minute |
| sec = | second |
| M = | molar |
| mM = | millimolar |
| μM = | micromolar |
| nM = | nanomolar |
| ml = | milliliter |
| μl = | microliter |
| nl = | nanoliter |
| mg = | milligram |
| μg = | microgram |
| kV = | kilovolt |
| HPLC = | high performance liquid chromatography |
| LC = | liquid chromatography |
| MS = | mass spectrometer |
| LCMS = | liquid chromatography/mass spectrometer |
| MALDI = | matrix assisted laser desorption |
| ES = | electrospray |
| ESI = | electrospray ionization |
| AP = | atmospheric pressure |

EXAMPLE 1

Ionization of "Chemical Ionization Compounds" by the Ion Source of the Present Invention To compare the effect of different ion sources, various analyte compounds were analyzed by LCMS using an ion source as described in FIG. 7 (AJS), atmospheric pressure chemical ionization (APCI), or a multimode ion source employing both chemical ionization and electrospray techniques (multimode, MM). The compounds were ionized by either positive mode (protonation to make positive ions M+H) or negative mode (deprotonation to make negative ions M−H). The effects of two different solvents, methanol (MeOH) and acetonitrile (ACN), were also tested. Therefore, there were four kinds of experiments:

Positive mode using methanol/Water and 0.05% trifluoroacetic acid

Positive mode using Acetonitrile/Water and 0.05% trifluoroacetic acid

Negative mode using Methanol/Water

Negative mode using Acetonitrile/Water

The experimental conditions were as follows:

LC Conditions (except for Ergocalciferol Positive MeOH/Water, in which a gradient was used):

Flow: 0.6 mL/min

Channel A (H2O): 50%

Channel B (MeOH or ACN): 50%

Column: 2.1×12.5 Zorbax StableBond C8

Run time: 1 min

Ergocalciferol Positive MeOH/Water Gradient

Flow: 0.6 mL/min

Gradient:

| Time | Channel A (H2O) | Channel B (MeOH) |
|---|---|---|
| 0 min | 20% | 80% |
| 1.5 min | 5% | 95% |

MS Condition:

Sheath gas flow: 12 L/min

Nebulizer pressure: 45 psi

Nozzle voltage: 0 for positive mode and +1500 for negative mode

Sample intake capillary voltage: grounded

Ion transfer capillary voltage: −2500 for positive mode and +2500 for negative mode Drying gas flow: 7 L/min Drying gas temp: 350 C Detector gain: 1

Scan mode: SIM (selected ion monitoring)

FIG. 12 shows the LC peak area response for 9-phenanthrol (100 pg) in negative mode, and FIGS. 13-15 show the responses for myristicin (500 pg), praziquantel (100 pg) and ergocalciferol (vitamin D2, 1 ng), respectively, in positive mode. These compounds traditionally had to be ionized by chemical ionization. Our results indicate that the ion source of this invention (AJS) can be used to ionize these compounds with similar or better efficiencies compared to APCI or multimode. The methanol/water combination produced the best signal for positive ionization mode using AJS, while the acetonitrile/water combination produced the best signal for negative ionization mode. The results also indicate that by tuning the nozzle voltage, ionization can be optimized. In these experiments, the nozzle voltage was 0 for positive mode and 1500 for negative mode.

REFERENCES

A. P. Bruins, Mass spectrometry with ion sources operating at atmospheric pressures, Mass Spec Review, 1991, 10, 53-77.

W. M. A. Niessen, Advances in instrumentation in liquid chromatography—mass spectrometry and related liquid-introduction techniques. J. Chromatography A, 794 (1998) 407-435.

U.S. Pat. No. 4,861,988.

U.S. Pat. No. 4,935,624.

M. L. Vestal, JASMS, 1992, 3, 18-26.

U.S. Pat. No. 5,352,892.

U.S. Pat. No. 5,412,208.

U.S. Pat. No. 5,495,108.

U.S. Pat. No. 6,759,650.

U.S. Pat. No. 7,199,364.

U.S. Pat. No. 6,998,605.

All of the publications, patents and patent applications cited in this application are herein incorporated by reference in their entirety to the same extent as if the disclosure of each individual publication, patent application or patent was specifically and individually indicated to be incorporated by reference in its entirety.

EXEMPLARY EMBODIMENTS

In addition to the embodiments described elsewhere in this disclosure, exemplary embodiments of the present invention include, without being limited to, the following:

1. An ion source comprising:

a housing that defines a chamber;

a capillary having a receiving end and a delivery end, wherein a liquid sample can be received from outside of the chamber through the receiving end and sprayed into droplets out of the delivery end in the chamber;

a conduit surrounding the capillary for transmitting a heated gas, the conduit being connected to a nozzle to release the heated gas into the chamber;

wherein the ion source is configured to maintain an overall electrical potential between the capillary and another surface in the chamber so that the droplets can be charged by the overall electrical potential;

the ion source further comprising one or more of the following features:

(1) a shielding layer between the capillary and the conduit, wherein the shielding layer can conduct heat and acts as a heat sink;

(2) the capillary is grounded;

(3) the nozzle comprises at least one electrodes, to which a potential can applied to contribute to said overall electrical potential; and (4) the nozzle and the capillary can be maintained at substantially the same voltage potential.

2. The ion source of embodiment 1, further comprising a tube surrounding the capillary for transmitting a nebulizing gas to a location near the delivery end of the capillary to nebulize the sample.

3. The ion source of embodiment 1 or 2, wherein the heated gas, and optionally the nebulizing gas, is released into the chamber in a flow parallel to the capillary.

4. The ion source of any one of the preceding embodiments, wherein the shielding layer extends outside of the housing to transmit heat away from the chamber.

5. The ion source of any one of the preceding embodiments, further comprising an insulator layer between the capillary and the conduit, the insulator layer being heat-insulating and electric-insulating.

6. The ion source of any one of the preceding embodiments, further comprising a gap between the capillary and the conduit, with the gap surrounding the capillary and the conduit surrounding the gap.

7. The ion source of embodiment 6, wherein the gap is in fluid communication with a cooling gas supply such that a cooling gas can be passed through the gap.

8. The ion source of any one of the preceding embodiments, wherein the nozzle comprises an inner nozzle element and an outer nozzle element, both the inner and outer nozzle elements surrounding the capillary, wherein the inner and outer nozzle elements are configured to operate at different potentials.

9. The ion source of any one of the preceding embodiments, wherein the delivery end of the capillary is 8 mm or less away from the nearest part of the nozzle where the heated gas is released.

10. The ion source of any one of the preceding embodiments, wherein the delivery end of the capillary is 6 mm or less away from the nearest part of the nozzle where the heated gas is released.

11. The ion source of any one of the preceding embodiments, wherein the delivery end of the capillary is 4 mm or less away from the nearest part of the nozzle where the heated gas is released.

12. The ion source of any one of the preceding embodiments, wherein the shielding layer comprises a copper layer that is coated with gold.

13. The ion source of any one of embodiments 1-11, wherein the nozzle is configured such that the heated gas flow exiting from the nozzle is at an angle relative to the capillary and directed at a point beyond the delivery end of the capillary.

14. The ion source of embodiment 13, wherein the point is 6 mm or less from the delivery end of the capillary.

15. The ion source of embodiment 13, wherein the point is 3 mm or less from the delivery end of the capillary.

16. The ion source of any one of the preceding embodiments, configured to release the heated gas at a velocity of 15 to 80 meters per second.

17. The ion source of any one of the preceding embodiments, configured such that the heated gas is at least 300° C. when it is released from the nozzle.

18. A mass spectrometer system or ion mobility spectrometer comprising the ion source of any one of the preceding embodiments, the mass spectrometer system further comprising a mass analyzer and an ion detector, and the ion mobility spectrometer further comprising an ion mobility separating device.

19. The mass spectrometer system or ion mobility spectrometer of embodiment 18, further comprising an inlet for transferring ions from the ion source to the mass analyzer or ion mobility separating device, wherein the inlet is capable of providing a voltage potential.

20. The mass spectrometer system or ion mobility spectrometer of embodiment 19, configured to maintain the capillary and the inlet at different voltage potentials.

21. The mass spectrometer system of embodiment 20, comprising an electrospray ion source and a quadrupole mass analyzer.

22. The mass spectrometer system of embodiment 20, comprising an electrospray ion source and a time-of-flight mass analyzer.

23. A method for generating ions from a liquid sample comprising analytes and a solvent, comprising:

passing the sample through a capillary;

in a chamber, spraying the sample into droplets out of the capillary;

subjecting the droplets to an electrical field to electrically charge at least some of the droplets;

providing a flow of heated gas from a nozzle into the chamber to confine the flow of the droplets;

whereby the solvent evaporates from the charged droplets to result in formation of analyte ions;

wherein the method further comprises one or more of the following:

(a) transmitting heat out of the chamber with a conductive material that is between the capillary and the heated gas;

(b) keeping the capillary at ground potential;

(c) providing at least a portion of the electrical field from the nozzle; and (d) maintaining the capillary and the nozzle at a same voltage potential.

24. The method of embodiment 23, further comprising providing a nebulizing gas to the droplets.

25. The method of embodiment 24, wherein the flows of the heated and nebulizing gases are concentric with the capillary.

26. The method of any one of embodiments 23-25, wherein the nozzle comprises multiple electrodes which are configured to operate at different electrical potentials.

27. The method of any one of embodiments 23-26, further comprising insulating the capillary from the heated gas flow with an insulating material, air gap, a flow of cooling gas, or any combination thereof.

28. The method of any one of embodiments 23-27, wherein the heated gas is released to a place that is 10 mm or less away from the end of the capillary where the sample is sprayed out.

29. The method of any one of embodiments 23-27, wherein the heated gas is released to a place that is 6 mm or less away from the end of the capillary where the sample is sprayed out.

30. The method of any one of embodiments 23-27, wherein the heated gas is released to a place that is 4 mm or less away from the end of the capillary where the sample is sprayed out.

31. The method of any one of embodiments 23-30, wherein the heated gas flow exiting from the nozzle is at a direction parallel to the capillary.

32. The method of any one of embodiments 23-20, wherein the heated gas flow exiting from the nozzle is at an angle relative to the capillary.

33. The method of embodiment 32, wherein the heated gas flow is directed at a point that is 6 mm or less away from the end of the capillary where the sample is sprayed out.

34. The method of embodiment 32, wherein the heated gas flow is directed at a point that is 3 mm or less away from the end of the capillary where the sample is sprayed out.

35. The method of any one of embodiments 23-34, wherein the heated gas is released at a velocity of 15-80 meters per second.

36. A method of analyzing a liquid sample by mass spectrometry, comprising generating ions from the sample using a method according to any one of embodiments 23-35, and analyzing the ions with a mass analyzer.

37. The method of embodiment 36, wherein the mass analyzer is a quadrupole mass analyzer or time-of-flight mass analyzer.

38. A method of generating ions from a less polar analyte that is traditionally ionized by chemical ionization, comprising subjecting the analyte to the ion source of any one of embodiments 1-17.

A number of embodiments of the invention have been described. Nevertheless, it will be understood that various modifications may be made without departing from the spirit and scope of the invention.

The invention claimed is:

1. An ion source comprising:

a housing that defines a chamber, and located inside the chamber:

a capillary having a receiving end and a delivery end, wherein a liquid sample can be received from outside of the chamber through the receiving end and sprayed into droplets out of the delivery end in the chamber;

a conduit surrounding the capillary for transmitting a heated gas, the conduit being connected to a nozzle to release the heated gas into the chamber;

wherein the ion source further comprises one or more of the following features:

(1) a shielding layer between the capillary and the conduit, wherein the shielding layer can conduct heat;

(2) the capillary is grounded;

(3) the nozzle comprises electrodes capable of generating an electrical field that can electrically charge at least some of the droplets; and (4) the nozzle and the capillary can be maintained at the same voltage potential.

2. The ion source of claim 1, further comprising a tube surrounding the capillary for transmitting a gas to a location near the delivery end of the capillary to nebulize the sample.

3. The ion source of claim 1, wherein the capillary and conduit, and optionally the tube, are concentric.

4. The ion source of claim 1, wherein the shielding layer extends outside of the housing to transmit heat away from the ion source.

5. The ion source of claim 1, further comprising an insulator layer between the capillary and the conduit, the insulator layer being heat-insulating and electric-insulating.

6. The ion source of claim 1, further comprising a gap between the capillary and the conduit, with the gap surrounding the capillary and the conduit surrounding the gap.

7. The ion source of claim 1, wherein the nozzle comprises an inner nozzle element and an outer nozzle element, both the inner and outer nozzle elements surrounding the capillary, wherein the inner and outer nozzle elements are configured to operate at different potentials.

8. The ion source of claim 1, wherein the delivery end of the capillary is 10 mm or less away from the nearest part of the nozzle where the heated gas is released.

9. The ion source of claim 1, wherein the nozzle is configured such that the heated gas flow exiting from the nozzle is parallel to the capillary.

10. The ion source of claim 1, wherein the nozzle is configured such that the heated gas flow exiting from the nozzle is at an angle relative to the capillary and directed at a point beyond the delivery end of the capillary.

11. The ion source of claim 10, wherein the point is 6 mm or less from the delivery end of the capillary.

12. A mass spectrometer system or ion mobility spectrometer comprising the ion source of claim 1, the mass spectrometer system further comprising a mass analyzer and an ion detector, and the ion mobility spectrometer further comprising an ion mobility separating device.

13. The mass spectrometer system of claim 12, comprising an electrospray ion source and a quadrupole mass analyzer.

14. The mass spectrometer system of claim 12, comprising an electrospray ion source and a time-of-flight mass analyzer.

15. A method for generating ions from a liquid sample comprising analytes and a solvent, comprising:

passing the sample through a capillary;

in a chamber, spraying the sample into droplets out of the capillary;

subjecting the droplets to an electrical field to electrically charge at least some of the droplets;

providing a flow of heated gas from a nozzle into the chamber to confine the flow of the droplets;

whereby the solvent evaporates from the charged droplets to result in formation of analyte ions;

wherein the method further comprises one or more of the following:

(a) transmitting heat out of the chamber with a conductive material that is between the capillary and the heated gas;

(b) keeping the capillary at ground potential;

(c) providing the electrical field from the nozzle; and (d) maintaining the capillary and the nozzle at a same voltage potential.

16. The method of claim 15, further comprising providing a nebulizing gas to the droplets.

17. The method of claim 16, wherein the flows of the heated and nebulizing gases are concentric with the capillary.

18. The method of claim 15, wherein the nozzle comprises multiple electrodes which are configured to operate at different electrical potentials.

19. The method of claim 15, further comprising insulating the capillary from the heated gas flow with an insulating material, air gap, a flow of cooling gas, or any combination thereof.

20. The method of claim 15, wherein the heated gas is released to a place that is 10 mm or less away from the end of the capillary where the sample is sprayed out.

* * * * *